US010539141B2

(12) United States Patent
Kulkarni et al.

(10) Patent No.: US 10,539,141 B2
(45) Date of Patent: Jan. 21, 2020

(54) SUBSEA PRODUCED NON-SALES FLUID HANDLING SYSTEM AND METHOD

(71) Applicants: Mohan G. Kulkarni, The Woodlands, TX (US); Kevin T. Corbett, Missouri City, TX (US); Paul M. Sommerfield, Giddings, TX (US); Kamran Ahmed Gul, Tomball, TX (US)

(72) Inventors: Mohan G. Kulkarni, The Woodlands, TX (US); Kevin T. Corbett, Missouri City, TX (US); Paul M. Sommerfield, Giddings, TX (US); Kamran Ahmed Gul, Tomball, TX (US)

(73) Assignee: ExxonMobil Upstream Research Company, Spring, TX (US)

( * ) Notice: Subject to any disclaimer, the term of this patent is extended or adjusted under 35 U.S.C. 154(b) by 0 days.

(21) Appl. No.: 15/710,473

(22) Filed: Sep. 20, 2017

(65) Prior Publication Data

US 2018/0156224 A1 Jun. 7, 2018

Related U.S. Application Data

(60) Provisional application No. 62/428,849, filed on Dec. 1, 2016.

(51) Int. Cl.
*E21B 43/12* (2006.01)
*E21B 43/36* (2006.01)
(Continued)

(52) U.S. Cl.
CPC ..... *F04D 25/0686* (2013.01); *E21B 43/128* (2013.01); *F04D 29/044* (2013.01); *E21B 43/36* (2013.01); *E21B 47/0005* (2013.01)

(58) Field of Classification Search
CPC .... E21B 43/128; E21B 43/36; F04D 25/0686; F04D 29/044
See application file for complete search history.

(56) References Cited

U.S. PATENT DOCUMENTS 6,893,486 B2 5/2005 Sanderford et al.
7,013,978 B2 * 3/2006 Appleford ..... E21B 43/36 166/105.5
(Continued)

FOREIGN PATENT DOCUMENTS

WO WO 97/40255 10/1997
WO WO 1999/035370 7/1999
(Continued)

OTHER PUBLICATIONS

Daigle et al., "*Treating and Releasing Produced Water at the Ultra Deepwater Seabed*," OTC 23622, 2012 Offshore Technology Conference, Houston, TX, Apr. 30-May 3, 2012, pp. 1-19.
(Continued)

*Primary Examiner* — Matthew R Buck
(74) *Attorney, Agent, or Firm* — ExxonMobil Upstream Reseach Company—Law Department

(57) ABSTRACT

A system, including: a subsea separation system that separates sales and non-sales fluids, wherein the subsea separation system includes a fluid polishing system; a seal-less pump that boosts production fluid pressure; and a water quality monitoring system, including an oil-in-water sensor and a solids-in-water sensor, that monitors a fluid discharged from the subsea separation system.

12 Claims, 7 Drawing Sheets

(51) Int. Cl.

| | |
|---|---|
| ***F04D 25/06*** | (2006.01) |
| ***F04D 29/044*** | (2006.01) |
| *E21B 47/00* | (2012.01) |

(56) References Cited

U.S. PATENT DOCUMENTS

| | | | | |
|---|---|---|---|---|
| 7,093,661 | B2 | 8/2006 | Olsen | |
| 7,140,441 | B2 * | 11/2006 | Hauge | E21B 43/34 166/267 |
| 7,234,524 | B2 | 6/2007 | Shaw et al. | |
| 7,520,989 | B2 * | 4/2009 | Ostergaard | B01D 17/00 166/267 |
| 8,220,551 | B2 * | 7/2012 | Fenton | E21B 43/36 166/267 |
| 8,534,364 | B2 | 9/2013 | Underbakke | |
| 8,813,854 | B2 * | 8/2014 | Sahni | E21B 43/20 166/263 |
| 9,079,639 | B2 * | 7/2015 | Chitwood | B63B 25/12 |
| 9,359,878 | B2 * | 6/2016 | Whitney | E21B 43/36 |
| 9,528,350 | B2 * | 12/2016 | Lunde | C02F 1/686 |
| 9,644,457 | B2 * | 5/2017 | Sathananthan | E21B 43/017 |
| 9,656,801 | B2 * | 5/2017 | Chitwood | B65D 88/022 |
| 2004/0256097 | A1 | 12/2004 | Byrd et al. | |
| 2005/0034869 | A1 * | 2/2005 | Appleford | E21B 43/36 166/357 |
| 2006/0243670 | A1 * | 11/2006 | Pinchin | C02F 1/688 210/748.11 |
| 2009/0077835 | A1 | 3/2009 | Yu et al. | |
| 2010/0032164 | A1 * | 2/2010 | Bakke | E21B 33/0355 166/366 |
| 2010/0116726 | A1 | 5/2010 | Dwek et al. | |
| 2012/0282116 | A1 * | 11/2012 | Tonnessen | E21B 41/0007 417/53 |
| 2012/0312754 | A1 * | 12/2012 | Eriksson | B04C 11/00 210/739 |
| 2013/0206423 | A1 | 8/2013 | Weinstock et al. | |
| 2014/0112803 | A1 * | 4/2014 | Hallset | E21B 41/0007 417/53 |
| 2015/0090124 | A1 | 4/2015 | Alqahtani | |
| 2015/0306520 | A1 | 10/2015 | Grave et al. | |
| 2015/0316072 | A1 | 11/2015 | Cunningham et al. | |
| 2015/0326094 | A1 | 11/2015 | Cunningham et al. | |
| 2015/0354574 | A1 | 12/2015 | Homstvedt | |
| 2016/0052799 | A1 | 2/2016 | Grave et al. | |
| 2016/0186759 | A2 | 6/2016 | Homstvedt | |
| 2016/0341025 | A1 * | 11/2016 | Bjartnes | E21B 43/36 |
| 2017/0174530 | A1 * | 6/2017 | Yin | C02F 1/008 |

FOREIGN PATENT DOCUMENTS

| | | | | |
|---|---|---|---|---|
| WO | WO 2015/103017 | | 7/2015 | |
| WO | WO-2016150961 | A1 * | 9/2016 | E21B 43/20 |
| WO | WO-2017001567 | A1 * | 1/2017 | E21B 43/20 |

OTHER PUBLICATIONS

Dirdal, "*Subsea Water Intake and Treatment—The Missing Link?*," SPE News Australia, Jan. 17, 2014.

Hernandez, T., "*A User's Engineering Review of Sealless Pump Design Limitations and Features*," Proceedings of the Eighth International Pump User's Symposium, 1991, pp. 129-146.

Offshore Magazine, Jan. 1, 2000, "*Raw water reservoir injection moves to the seabed*," 6 pages.

Yin, X, et al. (2015) "Flow-loop Testing of Subsea Produced Water Quality Monitoring Sensor Prototypes", *SPE-174808-MS*, Society of Petroleum Engineers Annual Technical Conference and Exhibition held in Houston, Texas, 28030 September; pp. 1-14.

* cited by examiner

SUBSEA PRODUCED NON-SALES FLUID HANDLING SYSTEM AND METHOD

CROSS REFERENCE TO RELATED APPLICATION

This application claims the benefit of U.S. Provisional Patent Application Ser. No. 62/428,849, filed Dec. 1, 2016, entitled "SUBSEA PRODUCED NON-SALES FLUID HANDLING SYSTEM AND METHOD," the entirety of which is incorporated by reference herein.

TECHNOLOGICAL FIELD

Exemplary embodiments described herein pertain to a system and method for extracting hydrocarbons from a subsea well. Specifically, embodiments described herein relate to the use of subsea equipment to separate and discharge non-sales fluid (e.g., water) and associated solids at the seabed.

BACKGROUND

This section is intended to introduce various aspects of the art, which may be associated with exemplary embodiments of the present technological advancement. This discussion is believed to assist in providing a framework to facilitate a better understanding of particular aspects of the present technological advancement. Accordingly, it should be understood that this section should be read in this light, and not necessarily as admissions of prior art.

A subsea production system utilizing any combination of equipment (trees, manifolds, jumpers, flow lines or pipelines, etc.) produces hydrocarbon sales fluids (oil or gas) from a subsea well or a plurality of wells. Non-sales fluids (primarily water, but may also include sand fines) are produced along with the sales fluids. A report on worldwide nominal water and oil production showed for every barrel of oil approximately four barrels of water are produced. The produced water may be transported to the host via production flow line with the oil or gas, or costly disposal wells are required to dispose of the produced water (as shown as FIGS. 1A and 1B). For either option, significant CAPEX is involved for topside equipment or subsea injection wells. The OPEX can be high too due to the need of mitigate produced water induced corrosion or solid induced erosion.

FIG. 1A depicts host facility 101 extending above the water line 102, with umbilical 103 (including hydraulic cables and hoses for chemical injection), power umbilical 104, production flow line 105, and gas export flow line 106. Umbilical 103 ends at umbilical termination assembly (UTA) 106, which then connects to subsea distribution units (SDUs) 107, in order to provide hydraulic power and/or chemicals to water injection manifold 108 (a subsea structure containing a network of valves and pipework designed to direct injection fluids to one or more subsea wells) and production manifold 109 (a subsea structure containing valves and pipework designed to commingle and direct produced fluids from multiple wells into one or more flow lines) via trees 110 (an assembly of valves, spools, pressure gauges, and chokes to control production or hydrocarbons or injection of water) that are connected to production manifold 109. The water injection manifold 108 can be connected to subsea water injection treatment (SWIT) system 111, which can include subsea chemical storage, and can obviate the need for an umbilical to supply chemicals. Power umbilical 104 can be connected to an UTA 106 and a transformer 112 to provide power for subsea production, injection or processing operations. The production line 105 can be routed from the production manifold 109 to the host via a high integrity pressure protection system (HIPPS) 115, separator system 114, and pump station 119. Gas export flow line 106 can be routed from the separator system via flow line termination (FLET) 116 to the host. The separator system 114 can separate water from production fluids and supply the water to the water injection manifold, for injection into water disposal wells 117. However, they system of FIG. 1A could alternatively have a water flow line back to host 101.

FIG. 1B shows a remote development scenario such as offshore arctic. Here the umbilical 103, power umbilical 104, production flow line 105, and gas export flow line 106 tied are to an onshore facility 117. A gas compression station 118 downstream of separator system 114 will likely be needed to boost gas pressure for transportation to the onshore facility 117. Gas compression station 118 can include a dehydration system.

While this document describes the discharge of non-sales fluids at the seabed, this is not necessarily a current industry practice. Furthermore, implementation of such discharge may require compliance with regulations governing produced water disposal and discharge of sand, and such regulations could prohibit such discharge in certain regions of the world.

SUMMARY

A system, including: a subsea separation system that separates sales and non-sales fluids, wherein the subsea separation system includes a fluid polishing system; a subsea seal-less pump that boosts production fluid pressure; and a water quality monitoring system, including an oil-in-water sensor and a solids-in-water sensor, that monitors a fluid discharged from the subsea separation system.

The system can further include a subsea gas compression system that transports gas to a topside or shore based hydrocarbon facility.

The system can further include a subsea chemical storage unit.

The system can further include a communication system that includes a fiber-optic communication cable between the top-side or shore based hydrocarbon facility and subsea equipment.

The system can further include an all-electric control system that operates the subsea separation system including a water polishing and a water discharge system, pumps, compressors, electrical equipment, HIPPS, subsea trees and manifolds.

The system can further include an optic-based pressure, temperature, flow, vibration, and production fluid phase sensors that make optical measurements and communicates with topside/shore based electronic components via the fiber-optic communications cable.

The system can further include a processor that receives measurements from optic-based pressure, temperature, flow, vibration, and production fluid phase sensors and uses the measurements in a feedback or feed-forward control process to control performance of the subsea separation system.

A method, including: separating, with a subsea separation system that includes a fluid polishing system, sales fluid and non-sales fluid; monitoring, with a water quality monitoring system that includes an oil-in-water sensor and a solids-in-water sensor, a fluid discharged from the subsea separation system; using a subsea seal-less pump to boost production fluid pressure; and discharging appropriate quality polished water at the seabed.

The method can further include using a subsea gas compression system to transport gas to a topside or shore based hydrocarbon facility.

The method can further include controlling subsea equipment with an all-electric control system.

The method can further include using a fiber optics communication system to communicate between topside equipment and subsea equipment.

The method can further include measuring variables using optic based sensors.

The method can further include receiving measurements from optic-based pressure, temperature, flow, vibration, and production fluid phase sensors and optimizing performance of the subsea separation system by using the measurements in a feedback or feed-forward control process.

BRIEF DESCRIPTION OF THE DRAWINGS

While the present disclosure is susceptible to various modifications and alternative forms, specific example embodiments thereof have been shown in the drawings and are herein described in detail. It should be understood, however, that the description herein of specific example embodiments is not intended to limit the disclosure to the particular forms disclosed herein, but on the contrary, this disclosure is to cover all modifications and equivalents as defined by the appended claims. It should also be understood that the drawings are not necessarily to scale, emphasis instead being placed upon clearly illustrating principles of exemplary embodiments of the present invention. Moreover, certain dimensions may be exaggerated to help visually convey such principles.

DETAILED DESCRIPTION

Figure 1A:
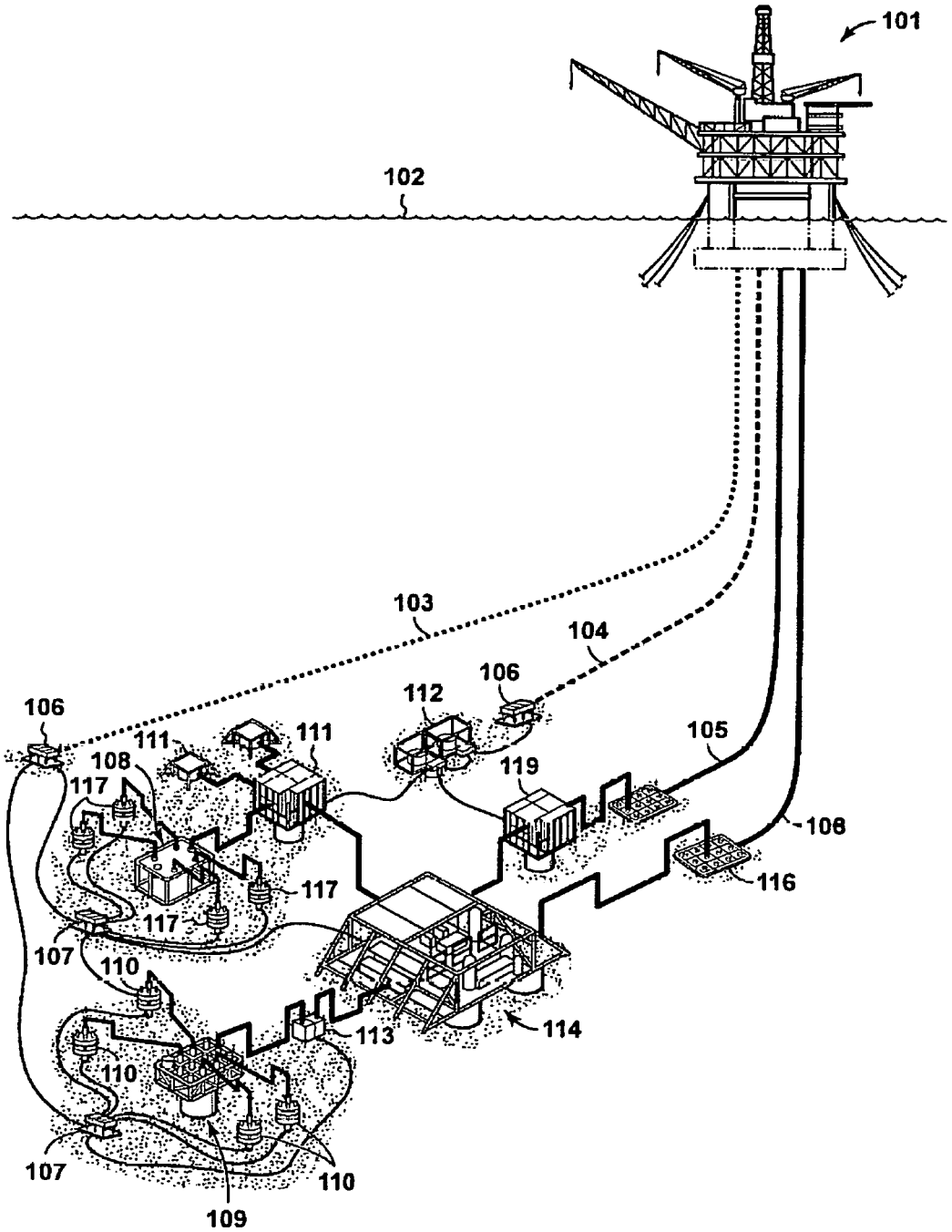
FIG. 1A PRIOR ART
FIG. 1A illustrates a subsea system with water disposal wells tied to a floating host.
Figure 1B:
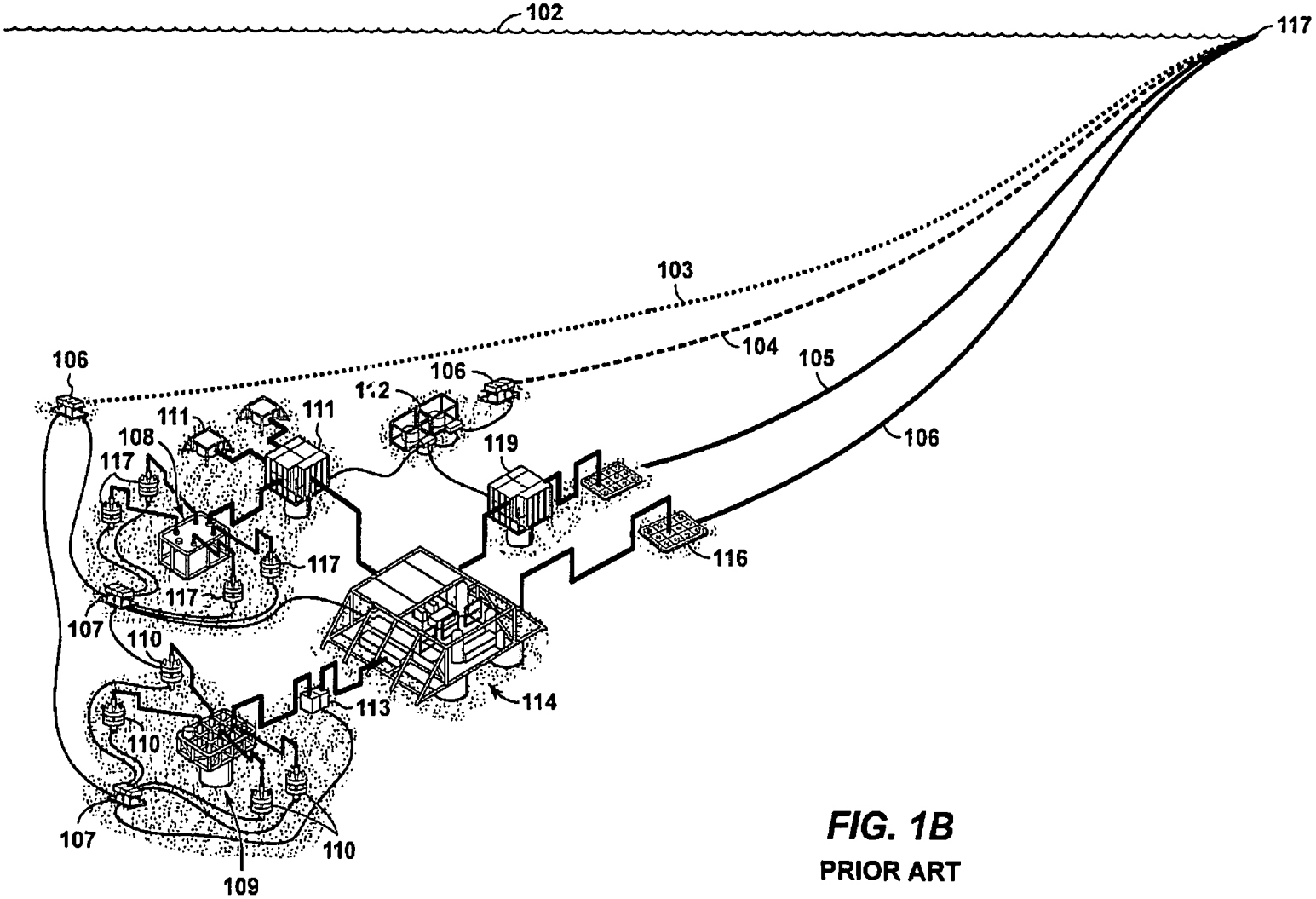
FIG. 1B PRIOR ART
FIG. 1B illustrates a subsea system with water disposal wells tied to an onshore facility.

Exemplary embodiments are described herein. However, to the extent that the following description is specific to a particular embodiment, this is intended to be for exemplary purposes only and simply provides a description of the exemplary embodiments. Accordingly, the invention is not limited to the specific embodiments described below, but rather, it includes all alternatives, modifications, and equivalents falling within the true spirit and scope of the appended claims.

The present technological advancement can provide a subsea produced non-sales fluid handling system that includes a combination of subsea equipment to separate and discharge water and associated solids in a cost-effective way—at the seabed. This system can reduce CAPEX and OPEX for subsea hydrocarbon resource development and production. The reduced CAPEX can be obtained by eliminating the water disposal wells, water disposal flow lines, as well as reducing the amount of topsides equipment necessary to handle the non-sales fluids. This system can also reduce or eliminate corrosion issues in production flow lines and pipelines and reduce hydrate inhibition requirements, which can significantly reduce OPEX. Oil and gas production volumes can also increase as larger gas flow lines and pipelines can be used with little-to-no liquid hold-up. In addition, slugging issues (varying or irregular flows of gas and liquids in pipelines) and back-pressure can be relieved from the wells, allowing them to flow more efficiently.

Non-limiting embodiments of the present technological advancement can result in the elimination of the water disposal well(s), water disposal flow line(s), and replacement of the large separate control/communication and power umbilicals with a single power and fiber optic communication cable. Additional benefits of the novel system include reduction in host size, equipment footprint, complexity, weight, and cost, improvements in reliability of the subsea control system and subsea pumps, and reduction or elimination of corrosion and hydrate inhibition requirements and other flow assurance issues.

The present technological advancement can include a subsea processing system including a gravity-based or compact separation system, with all ancillary components necessary to process (de-oil, polish, etc.) the non-sales fluids prior to discharge, a subsea dehydration system that prepares the gas for transport or first stage compression prior to transport to host facilities, a subsea produced water quality monitoring (PWQM) system including oil-in-water sensors and solids-in-water sensors to monitor the discharged fluids, a combination of subsea equipment (manifold, jumpers etc.) for gathering oil, gas and water stream to the separation system, and a combination of subsea equipment (valves, pipes, pumps) to be used to discharge non-sales fluids at the seabed.

Pumps may be required to enable the disposal of produced water at the seabed (to overcome the pressure difference if separator operating pressure is lower than the ambient pressure) or inject chemicals. The pumps for the processing and chemical injection systems could be seal-less (magnetic drive or canned motor) pumps. Such pumps provide higher reliability by eliminating the need for mechanical seals between the motor and pump shafts, and simplify the barrier fluid system.

Figure 2A:
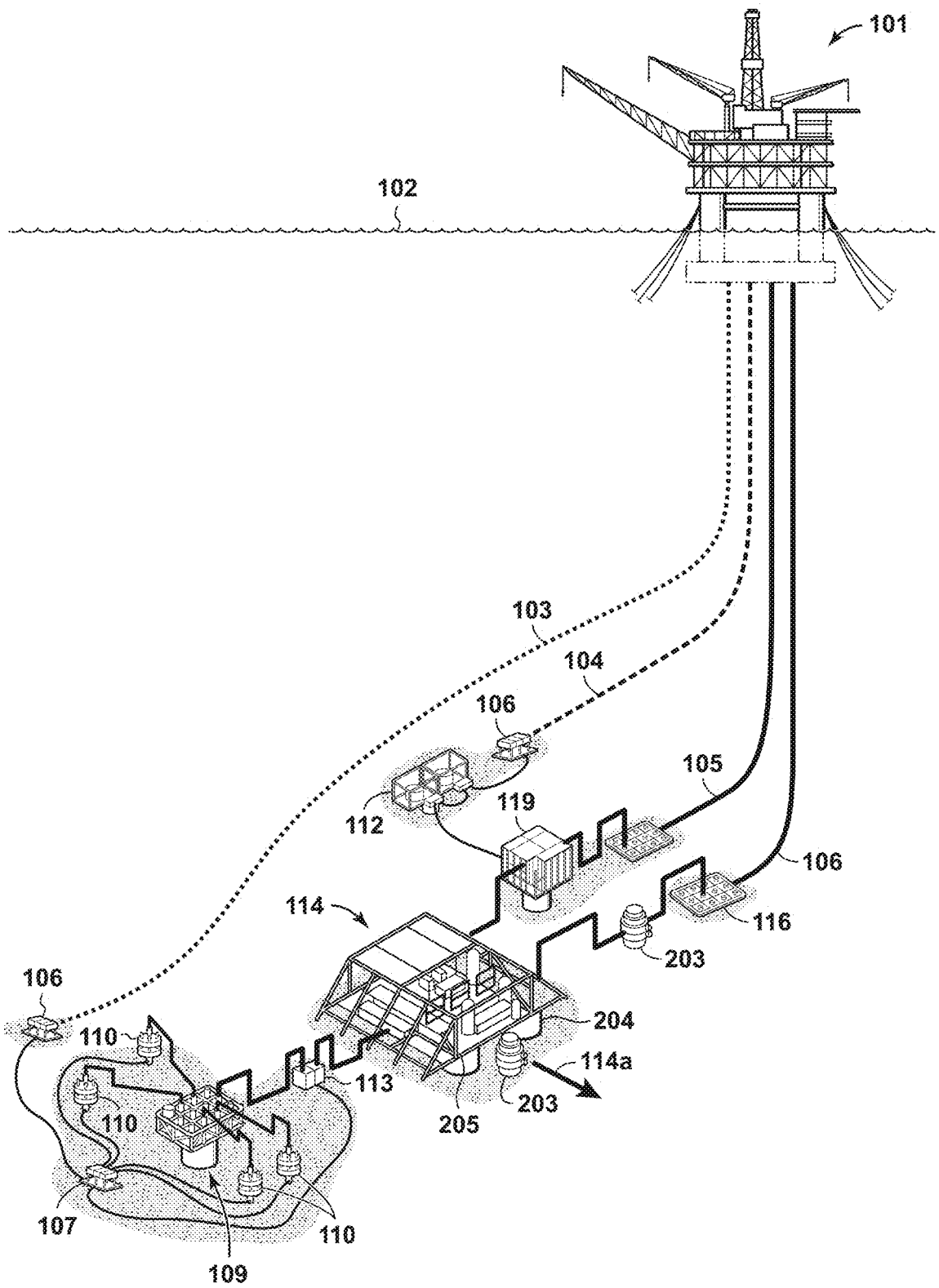
FIG. 2A illustrates a non-limiting embodiment of the present technological advancement where non-sales fluids are discharged to the sea and disposal wells are eliminated, and the system is tied to a floating host.

FIG. 2A illustrates a non-limiting embodiment of the present technological advancement where non-sales fluids are discharged to the sea and disposal wells are eliminated, and the system is tied to a floating host. In this non-limiting embodiment, the water injection wells have been eliminated (compare FIG. 1A to 2A) and non-sales fluid is discharged at the sea bed via port 114*a*. The host facility 101 is connected to subsea equipment via umbilical 103, and power umbilical 104. Subsea production is transported to host facility 101 using production and gas flow lines 105 and 106 respectively. Umbilical 103 can include communication and hydraulic tubes. A separate power umbilical 201 is included for the pump station 119. The host facility 101 could be a semi-submersible, spar, tension-leg platform, other floating structure, gravity based structure, other bottom founded structure, or onshore facility for processing, storing, and/or extracting hydrocarbons. Not all possible variations of the facility are shown in the figures. As used herein, an umbilical or umbilical cable is cable and/or hose which supplies required consumables to an apparatus.

The system shown in FIG. 2A can use pump(s) 203 for boosting water pressure in order to overcome the pressure difference if the separator 114 operating pressure is lower than ambient pressure and for injecting chemicals. The pumps can be conventional single phase subsea pumps currently available. Alternatively, additional improvements in the life-cycle cost and reliability of the system can be obtained through the use of seal-less subsea pumps. Such pumps provide higher reliability by eliminating the need for mechanical seals between the motor and pump shafts, and simplify the barrier fluid system.

Typically, a seal-less pump design can be achieved using a canned motor pump or a magnetic coupling. Such seal-less pumps are disused in *A User's Engineering Review of Sealless Pump Design Limitations and Features*, T Hernandez, *Proceedings of the Eighth International Pump User's Symposium,* 1991, pp. 129-146 (the entirety of which is hereby incorporated by reference). Further exemplary details of a seal-less pump can be found, for example, in U.S. Patent Publication 2015/0354574, the entirety of which is hereby incorporated by reference.

The system can also include subsea chemical storage 204 for treating production lines and/or injection lines, or as needed. Seabed chemical storage is a new technique, whereas chemicals have been previously stored and pumped from the host facility to its mixing point using umbilical tube(s). Seabed chemical storage and mixing can provide further CAPEX reduction through smaller topside equipment footprint and elimination of umbilical tube(s) used for chemical transport. Chemicals for water treatment can include chlorination, sulfate removal, and/or biocide dosing. Other chemicals used for subsea production systems include MeOH, corrosion inhibitors if needed, asphaltene inhibitor, scale inhibitor, etc. The non-sales fluid that is discharged can be treated to comply with environmental discharge standards, as applicable. The subsea chemical storage units 204 can store enough chemical for a given period and can be refilled periodically using a shuttle tank. Subsea storage of chemicals will eliminate the need for injection chemical umbilical tube(s).

Separator system 114 can include fluid polishing system 205. Any of the existing fluid polisying technologies can be used with the present technological advancement.

The present technological advancement can also include a subsea produced water quality monitoring (PWQM) system, which includes oil-in-water sensors, disposed at or near port 114*a*, and solids-in-water sensors, disposed at or near port 114*a*, to monitor the discharged fluids. Any existing sensors can be used along with the present technological advancement.

Furthermore, various subsea equipment can be outfitted with optically based sensors. These sensors can communicate with computer systems and/or control modules located topside or subsea via fiber optic cables.

Typically, all subsea production or processing equipment are provided with a subsea control module to control functionality of valves included on the subsea equipment, wherein the subsea control module is communicatively coupled to a topside master control station. All subsea equipment (trees, manifolds, pumps, etc.) can contain sensors for process variable (flow, temperature, pressure) measurements, wherein the sensors can be optically based.

Figure 2B:
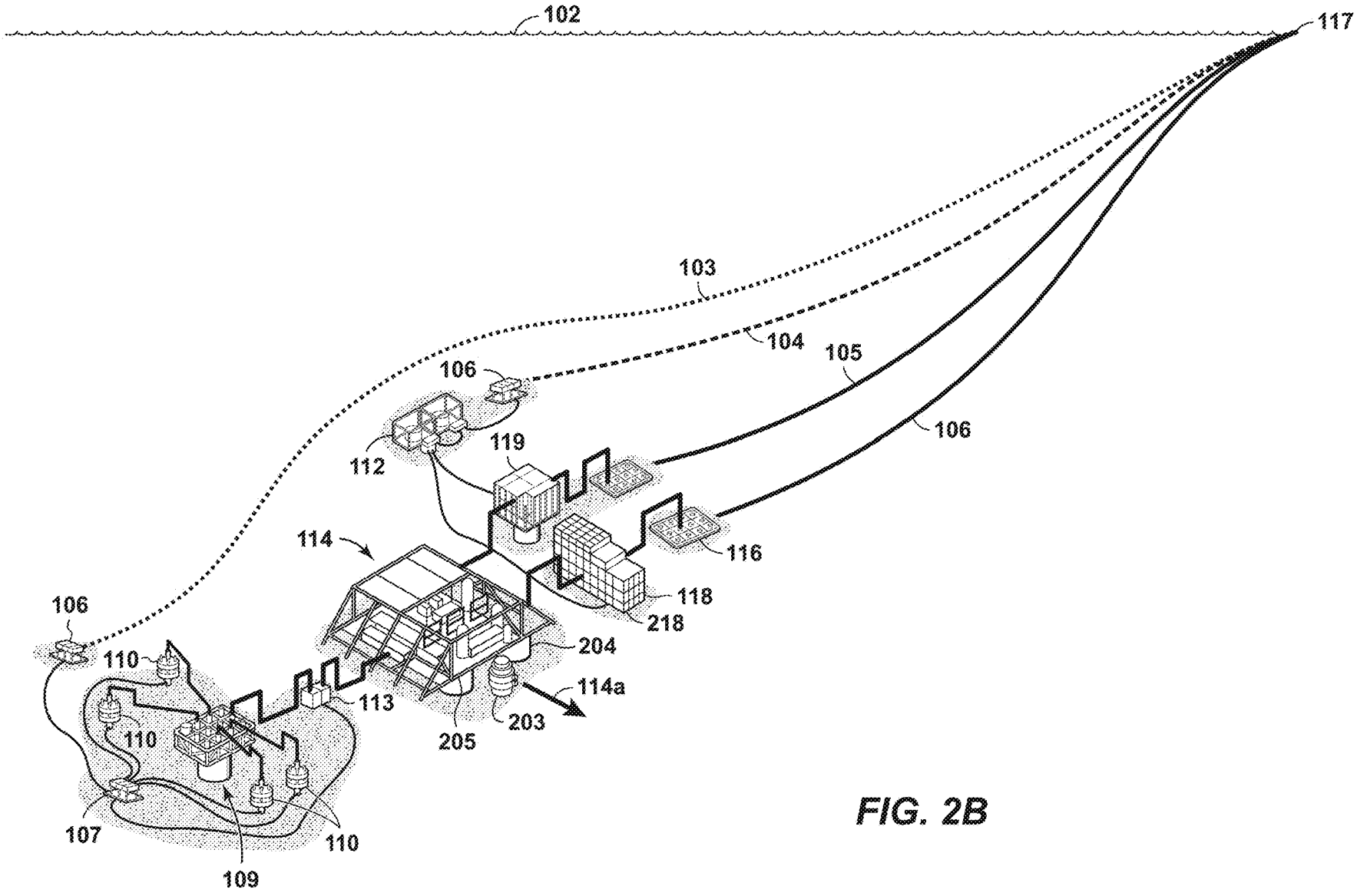
FIG. 2B illustrates a non-limiting embodiment of the present technological advancement where non-sales fluids are discharged to the sea and disposal wells are eliminated, and the system is tied to an onshore facility. Such embodiment can be used in, but is not limited to, remote offshore development scenarios.

FIG. 2B illustrates a non-limiting embodiment of the present technological advancement where non-sales fluids are discharged to the sea and disposal wells are eliminated, and the system is tied to an onshore facility. Otherwise, the exemplary embodiment illustrated in FIG. 2B includes features as noted above in FIG. 2A.

In FIG. 2B, the gas compression station 118 can include dehydration system 218. Compression station 118 can be used to boost gas pressure to allow transportation of gas to the onshore facility 117. Dehydration system 218 removes water and/or water vapor from the gas. This prevents hydrates from forming at the low temperature and high pressure of the gas export flow line 106. Examples of dehydration system 218 include, but is not limited to, a glycol dehydrator or a dry-bed dehydrator. However, other types of dehydration systems are useable with the present technological advancement.

The present technological advancement can use an all-electric control system (AC or DC power based) for operating subsea production and processing equipment (trees, manifolds, separator, dehydrator, pumps etc.). The use of all-electric control system will further simplify the umbilical by eliminating the need for hydraulic fluid tubes and can improve the reliability of subsea control system by eliminating complex components (such as directional control valves) in the conventional electro-hydraulic control systems. Further, fiber optic communications can be integrated within the control system to provide higher reliability (i.e. low noise) communications and increased bandwidth.

Figure 3A:
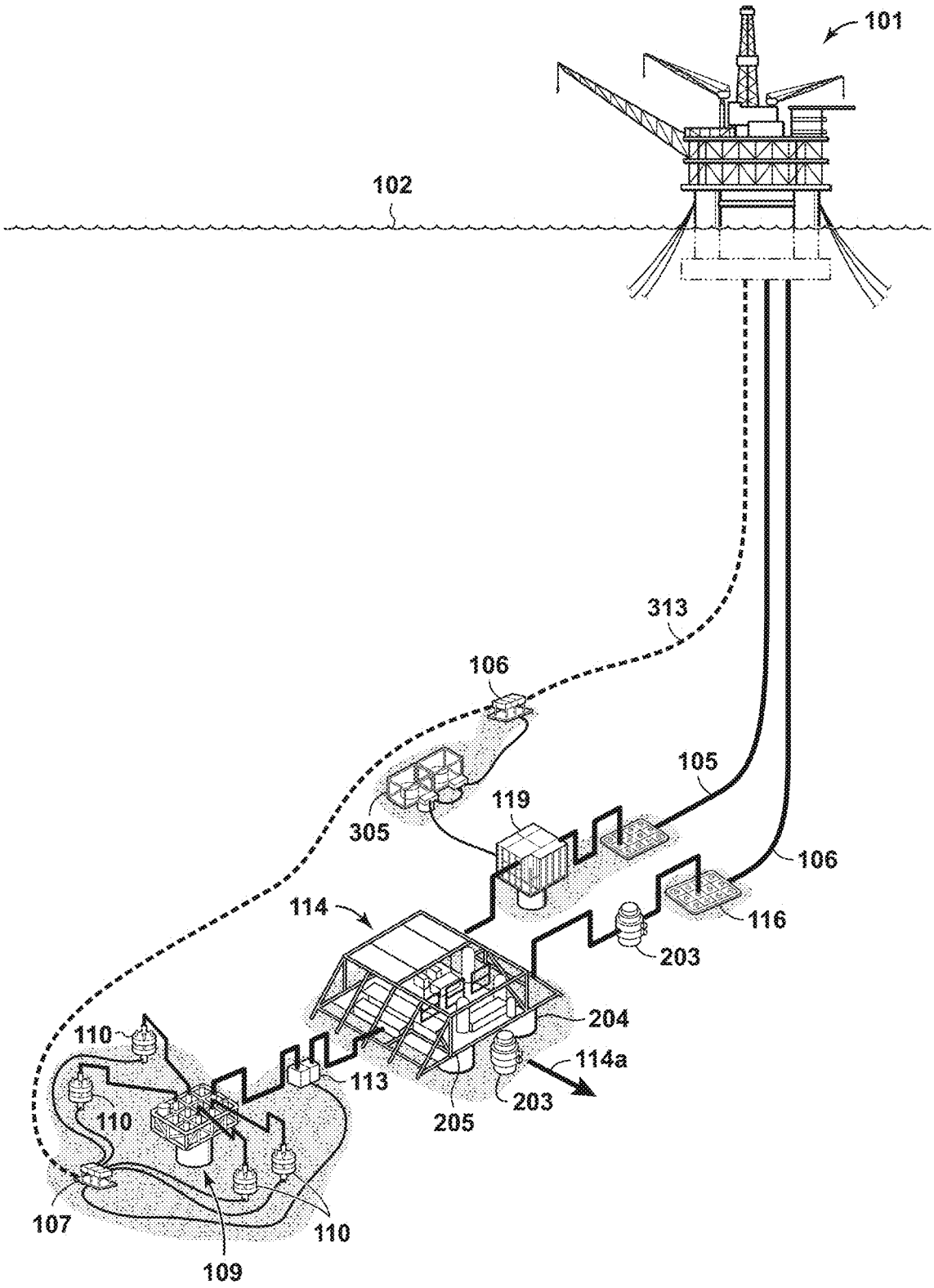
FIG. 3A illustrates a non-limiting embodiment of the present technological advancement where non-sales fluids are discharged to the sea and disposal wells are eliminated, and the system is tied to a floating host.

FIG. 3A illustrates a non-limiting embodiment of the present technological advancement where non-sales fluids are discharged to the sea and disposal wells are eliminated, and the system is tied to a floating host. FIG. 3A illustrates a system similar to that of FIG. 2A, wherein the separate umbilical 103 and power umbilical 104 in FIG. 2A are replaced with a combined power and communications cable 313. This simplified umbilical design is enabled through use of all-electric control system and eliminates hydraulic, barrier fluid and chemical injection tubes.

The combined power and communications cable 313 can provide electric power for a subsea all-electric control system (AC or DC power with transformer 305 as needed) with electronics and instrumentation that are configured for safe and efficient operation of all subsea equipment. The subsea all-electric control system can include a master control station that is topside with electrical cables and electrically operated actuators for valve operations subsea, and can be communicatively connected to all subsea sensors. Example sensors include pressure, temperature, vibration sensors, flow meters. Each of the sensors can use reliable optics-based measurement principle and communicate with topside or shore-based electronic components via a fiber-optic communications cable.

The present technological advancement can also include a monitoring, and process (separation, de-oiling, polishing, dehydration) and equipment (separators, dehydrators, compressors, chemical storage, seal-less pumps, and control system) performance optimization system. All sensors measurements can be used in a computer controlled feedback and/or feed-forward controlled mechanism using mechanical/process algorithms to optimize process and equipment performance. Such a computer can include control circuitry and/or one or more processors that are programmed to execute instructions stored in a computer readable memory in order to execute a method in accordance with the present technological advancement. For example, performance of subsea equipment can be optimized, such as pump operating point (combination of power consumption, output head and flow rate) and at a system level, water discharge pressure and/or rate can be optimized to get maximum hydrocarbon production rate.

Figure 3B:
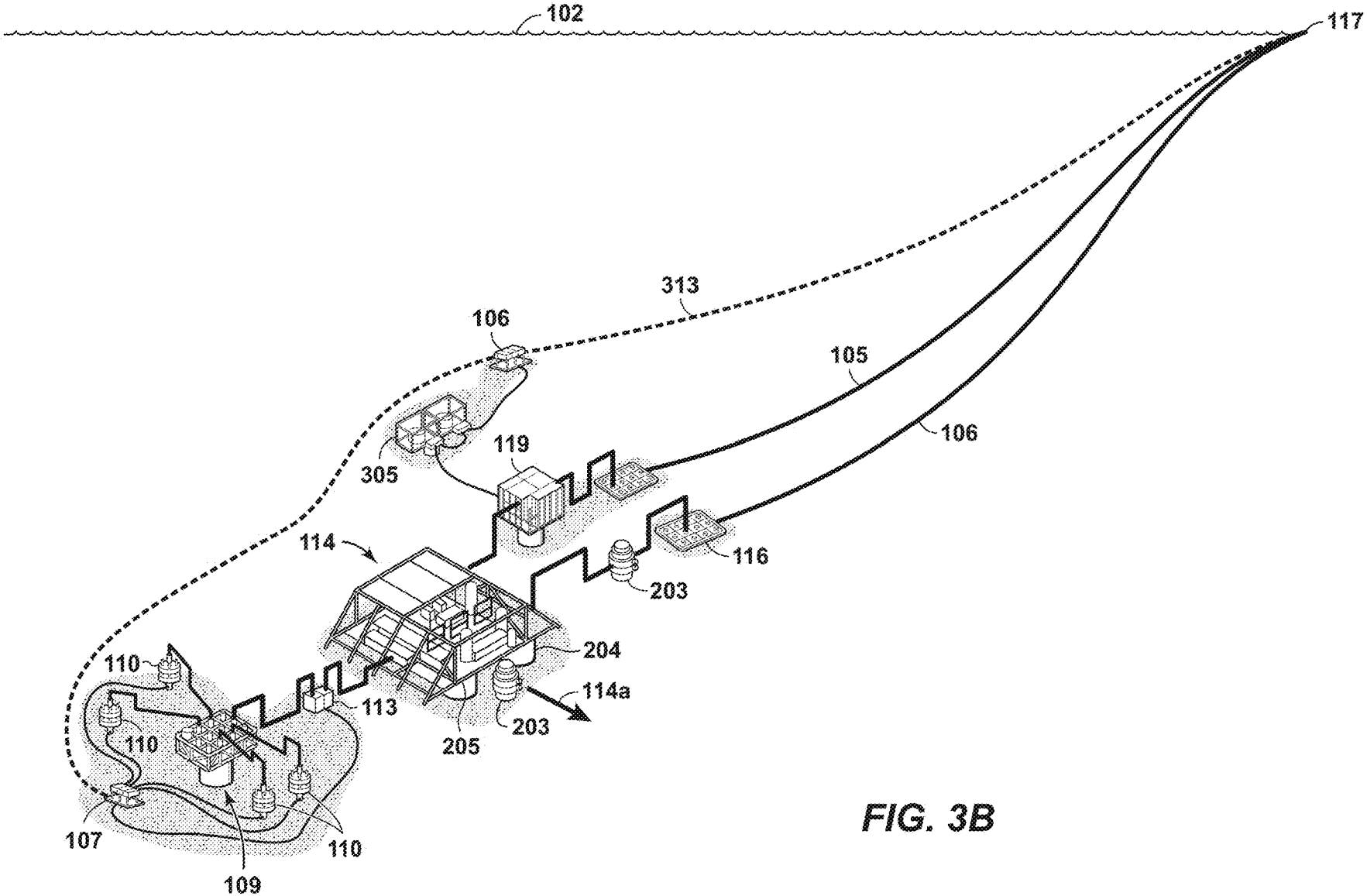
FIG. 3B illustrates a non-limiting embodiment of the present technological advancement where non-sales fluids are discharged to the sea and disposal wells are eliminated, and the system is tied to an onshore facility.

FIG. 3B illustrates a non-limiting embodiment of the present technological advancement where non-sales fluids are discharged to the sea and disposal wells are eliminated, and the system is tied to an onshore facility. FIG. 3B illustrates a system with features from FIGS. 1B and 3A, wherein the system is connected to an onshore facility.

The present technological advancement can be used in the management of hydrocarbons. As used herein, hydrocarbon management includes hydrocarbon extraction, hydrocarbon production, hydrocarbon exploration, identifying potential hydrocarbon resources, identifying well locations, determining well injection and/or extraction rates, identifying reservoir connectivity, acquiring, disposing of and/or abandoning hydrocarbon resources, reviewing prior hydrocarbon management decisions, and any other hydrocarbon-related acts or activities.

Figure 4:
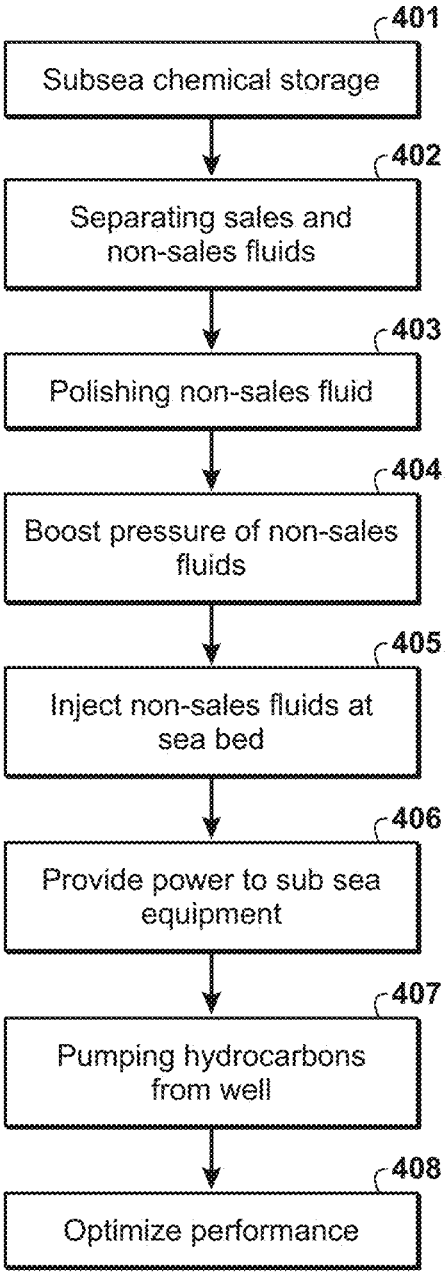
FIG. 4 illustrates an exemplary method of extracting hydrocarbons with the present technological advancement.

The present technological advancement can also be embodied as a method to extract hydrocarbons, an exemplary embodiment of which is shown in FIG. 4. The steps of this method are not necessarily performed in the order recited herein and one or more steps can be performed simultaneously. Step 401 can include storing a chemical in a subsea storage unit. Step 402 can include separating sea water (or non-sales fluid) from hydrocarbons (sales fluids) via separator system 114. Step 403 can include treating the non-sales fluid via polishing. Step 404 can include boosting pressure, with a seal-less subsea pump, of the polished seawater received from the separator system in order to overcome the ambient pressure. Step 405 can include injecting the non-sales fluid into the sea water at the seabed. Step 406 can include providing power (hydraulic and/or electric for electric or electro-hydraulic controls for all equipment) to the subsea equipment. Step 407 can include pumping hydrocarbons from a well to host 101 or onshore facility 117. Step 407 can include using a subsea gas compression system, including a dehydration system, that boosts gas pressure to transport gas to a topside or shore based hydrocarbon facility. In step 408, optimized performance of the subsea equipment can be controlled via a diagnostic/prognostic/optimization computer processor.

The present techniques may be susceptible to various modifications and alternative forms, and the examples discussed above have been shown only by way of example. Indeed, the present techniques include all alternatives, modifications, and equivalents falling within the spirit and scope of the appended claims. While the present technological advancement has been explained via multiple examples, features from these examples may be combined as would be recognized by those of ordinary skill in the art. The present techniques are not intended to be limited to the particular examples disclosed herein.

REFERENCES

The following references are hereby incorporated by reference in their entirety: U.S. patent publications 2015/0354574, 2016/0186759, 2015/0326094, 2015/0316072; 2015/0090124, 2013/0206423, 2010/0116726, 2009/0077835, 2005/0034869, and 2004/0256097; U.S. Pat. Nos. 8,534,364, 7,093,661, and 6,893,486; European patent publication EP894182; International patent publications WO2015103017 and WO1999035370; "Raw water reservoir injection moves to the seabed," Offshore Magazine, Jan. 1, 2000; "Treating and Releasing Produced Water at the Ultra Deepwater Seabed," 2012 Offshore Technology Conference, Daigle et al., and "Subsea Water Intake and Treatment—The Missing Link?", SPE News Australasia, Eirik Dirdal, 17 Jan. 2014.

What is claimed is:

1. A system, comprising:

a plurality of manifolds for gathering oil, gas and water from a plurality of wells via a plurality of subsea trees which are fluidly connected to the plurality of wells;

at least one subsea distribution unit (SDU), wherein the at least one SDU is fluidly connected to at least one of the plurality of manifolds and is configured to provide hydraulic power and chemicals to the at least one of the plurality of manifolds;

a subsea separation system fluidly connected to the plurality of manifolds, wherein the subsea separation system separates a first sales fluid comprising the oil, a second sales fluid comprising the gas, and a non-sales fluid comprising the water, wherein the subsea separation system includes a fluid polishing system;

a subsea chemical storage unit for supplying chemicals to the fluid polishing system for treating the non-sales fluid;

a subsea seal-less pump that boosts the pressure of the non-sales fluid;

a water quality monitoring system, including an oil-in-water sensor and a solids-in-water sensor, that monitors the non-sales fluid discharged from the subsea separation system into a subsea environment;

a subsea pumping system that transports the first sales fluid to a topside or shore based hydrocarbon facility;

a subsea gas compression system that transports the second sales fluid to the topside or shore based hydrocarbon facility through a gas flow line which is fluidly connected to the subsea gas compression system; and a subsea dehydration system fluidly located between the subsea gas compression system and the gas flow line and configured for removing gas-entrained water, gas-entrained water vapor, or a combination thereof from the second sales fluid.

2. The system of claim 1, further comprising a communication system that includes a fiber-optic communication cable between the top-side or shore based hydrocarbon facility and the subsea separation system.

3. The system of claim 1, further comprising an all-electric control system that operates the subsea separation system including a water polishing and a water discharge system, pumps, compressors, electrical equipment, HIPPS, the subsea trees and the plurality of manifolds.

4. The system of claim 2, further comprising an optic-based pressure, temperature, flow, vibration, and production fluid phase sensors that make optical measurements of the subsea separation system and communicates the optical measurements with topside/shore based electronic components via the fiber-optic communications cable.

5. The system of claim 4, further comprising a processor that receives measurements from optic-based pressure, temperature, flow, vibration, and production fluid phase sensors and uses the measurements in a feedback or feed-forward control process to control performance of the subsea separation system.

6. The system of claim 1, wherein the subsea dehydration system comprises a glycol dehydrator or a dry-bed dehydrator.

7. A method, comprising:

transferring, via a plurality of manifolds, oil, gas and water from a plurality of wells via a plurality of subsea trees which are fluidly connected to the plurality of wells to a subsea separation system;

providing hydraulic power and chemicals to at least one of the plurality of manifolds via at least one subsea distribution unit (SDU);

separating, with the subsea separation system that includes a fluid polishing system, a first sales fluid comprising the oil, a second sales fluid comprising the gas, and a non-sales fluid comprising the water;

chemically treating the non-sales fluid in the fluid polishing system with chemicals supplied from a subsea chemical storage unit;

monitoring, with a water quality monitoring system that includes an oil-in-water sensor and a solids-in-water sensor, the non-sales fluid discharged from the subsea separation system;

using a subsea seal-less pump to boost the pressure of the non-sales fluid;

discharging appropriate quality non-sales fluid at the seabed into a subsea environment;

using a subsea pumping system to transport the first sales fluid to a topside or shore based hydrocarbon facility;

using a subsea gas compression system to transport the second sales fluid to the topside or shore based hydrocarbon facility through a gas flow line which is fluidly connected to the subsea gas compression system;

using a subsea dehydration system, fluidly located between the subsea gas compression system and the gas flow line, and configured to remove gas-entrained water, gas-entrained water vapor, or a combination thereof from the second sales fluid prior to passing the second sales fluid to the gas flow line.

8. The method of claim 7, further comprising controlling the subsea separation system with an all-electric control system.

9. The method of claim 7, further comprising: using a fiber optics communication system to communicate between the topside or shore based hydrocarbon facility and the subsea separation system.

10. The method of claim 7, further comprising measuring variables using optic based sensors.

11. The method of claim 7, further comprising receiving measurements from optic-based pressure, temperature, flow, vibration, and production fluid phase sensors and optimizing performance of the subsea separation system by using the measurements in a feedback or feed-forward control process.

12. The method of claim 7, wherein the subsea dehydration system comprises a glycol dehydrator or a dry-bed dehydrator.

* * * * *